United States Patent [19]

Bardsley

[11] 4,303,024

[45] Dec. 1, 1981

[54] TUFTING MACHINE HOOK MODULE

[75] Inventor: Harold B. Bardsley, Euxton, Near Chorley, England

[73] Assignee: Spencer Wright Industries, Inc., Chattanooga, Tenn.

[21] Appl. No.: 153,727

[22] Filed: May 27, 1980

[30] Foreign Application Priority Data

Apr. 26, 1980 [GB] United Kingdom ..... 13847/80

[51] Int. Cl.[3] ..... D05C 15/00

[52] U.S. Cl. ..... 112/79 R

[58] Field of Search ..... 112/79 R, 79 A

[56] References Cited

U.S. PATENT DOCUMENTS

| | | | |
|---|---|---|---|
| 3,492,956 | 2/1970 | Webb | 112/79 R |
| 3,878,800 | 4/1975 | Collier et al. | 112/79 R |
| 4,003,321 | 1/1977 | Card | 112/79 R |
| 4,158,339 | 6/1979 | Short | 112/79 R |
| 4,194,457 | 3/1980 | Parsons | 112/79 R |

*Primary Examiner*—Ronald Feidbaum

*Attorney, Agent, or Firm*—Alan Ruderman

[57] ABSTRACT

A tufting machine hood module having a number of hooks embedded within a common cast body member in side-by-side disposition. The hooks are of the staggered type with alternate hooks having a first blade length and the intermediate hooks having a second and different blade length. The throats of all of the hooks are transversely aligned so that when the hooks require regrinding the throats may be ground as a unit.

2 Claims, 4 Drawing Figures

TUFTING MACHINE HOOK MODULE

BACKGROUND OF THE INVENTION

This invention relates to tufting machine gauge parts and more particularly to modular tuft-forming hooks for staggered needle cut pile tufting machines.

In the production of tufted cut-pile fabric each reciprocating needle cooperates with a looper or hook, the hook seizing a loop from the needle and holding the loop until it is cut by a knife acting in scissors-like fashion with the hook.

It has been found that the transverse pressure applied to the individual hooks by the respective knives can give rise to deflection of the tips of the hooks. The magnitude of the deflection, and, in consequence, the extent to which such deflection adversely affects accurate and consistent pick-up of yarn from the corresponding needle is determined, at least in part, by the closeness of the fit of the hook in the slot in the hook bar and by the length of the bill. Having regard to the manufacturing tolerances and clearances which must necessarily be provided, both in connection with the hook bar arrangement and the needle bar arrangement, it sometimes happens that the deflection of the hook tip in any instance is such as deleteriously to affect loop pick-up, with consequential impairment of the uniformity of the tufted fabric. Furthermore, in the event of damage to a series of hooks or when such hooks are worn, the replacement of a new set is particularly demanding of time.

To overcome these problems it has been proposed to provide in cut-pile tufting machines having in-line co-operating needles and identical in-line hooks, a hook mounting wherein the respective hook shanks are imbedded in a common body member in side-by-side disposition. Such constructions are illustrated in U. K. Design Nos. 980,060 and 980,062. This construction has the advantage of eliminating difficulties of aligning the hooks in the hook bar of a tufting machine since the hooks are aligned in the formation of the modules and each body member may have an alignment surface for clamping to a hook bar in the machine without the need for alignment of the individual hooks in the relatively uncontrolled conditions of a tufting mill.

It is also known in the art to provide tuft-forming instrumentalities for a tufting machine intended to produce cutpile fabric wherein the needles are arranged in staggered relationship on a needle bar and wherein those hooks intended for co-operation with respective ones of the row of needles furthest from the hook bar on which the hooks are mounted have a longer bill than the hooks intended for co-operation with the other row of hooks. For ease of aligning the hooks in the hook bar, the throats of both the long billed hooks and the remaining hooks may be in alignment in the longitudinal direction of the hook bar and each hook secured in position within a respective slot in the hook bar by screw means. A cutting knife is provided for each hook, and the individual knives are similarly aligned transversely of the machine. Tufting machines having this construction are illustrated in U.S. Pat. Nos. 4,003,321 and 3,913,505.

Although orginally proposed to minimize the deflection of the tips of the hooks in tufting machines having a staggered needle construction, the utilization of the modular concept also alleviates the need to provide aligned throats of adjacent hooks. The hooks may be positioned side-by-side in a module body member with the throat portion of adjacent hooks laterally spaced in the module by the amount of the staggered offset pitch of the tips of the bills or some other convenient amount. Difficulties, however, may develop after the hooks have been operating for some time. Since the knives act against the edge of the cooperating hooks, wear on the hooks occurs. The individual hooks of a module cannot be replaced without destroying the module body member so regrinding of the knife engaging position of the hooks has been proposed. Conventionally hooks have been reground by grinding the face of the hook against which the knife acts to again obtain a sharp cutting edge. However, grinding of the hooks of an integral modular assembly of hooks, especially when the hook gauge, i.e., space between adjacent hooks is in the order of less than 0.1 inch, creates difficulties since there is no adequate space between the hooks for receiving the grinding wheel.

SUMMARY OF THE INVENTION

In order to overcome these difficulties it is now proposed to regrind the throats of the hooks as a unit rather than the hook faces. To do this the throats of the hooks are aligned in the module and when regrinding is required a grinding wheel can be positioned to regrind all the hooks in the module by passing the grinding wheel over the hook blade at the throats.

Consequently, it is the object of the present invention to provide a staggered blade hook module having in-line throats so that the hooks can be reground in the module when necessary.

According to the present invention there is proposed a hook module for the tuft-forming instrumentalities of a tufting machine which comprises a multiplicity of hooks imbedded in a common body part to extend outwardly therefrom in spaced side-by-side disposition, alternate hooks being of a first blade length and intermediate hooks being of a second, and different, blade length, but the throats of the hooks being arranged in alignment transversely of the multiplicity of hooks so the hooks may be reground when required.

BRIEF DESCRIPTION OF THE DRAWINGS

The invention will now be described further, by way of example only, with reference to the accompanying drawings illustrating one embodiment thereof and in which.

DESCRIPTION OF THE PREFERRED EMBODIMENT

Figure 1:
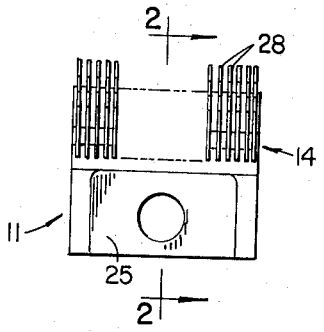
FIG. 1 is a front elevation of a hook module constructed in accordance with the invention.
Figure 2:
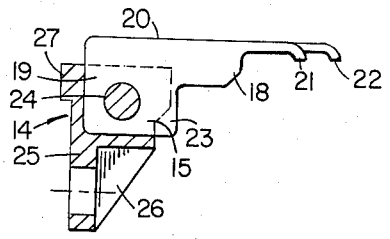
FIG. 2 is a cross-sectional view taken substantially along line 2—2 of FIG. 1.
Figure 3:
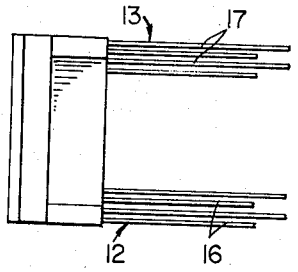
FIG. 3 is an inverted plan view of the arrangement shown in FIG. 1.
Figure 4:
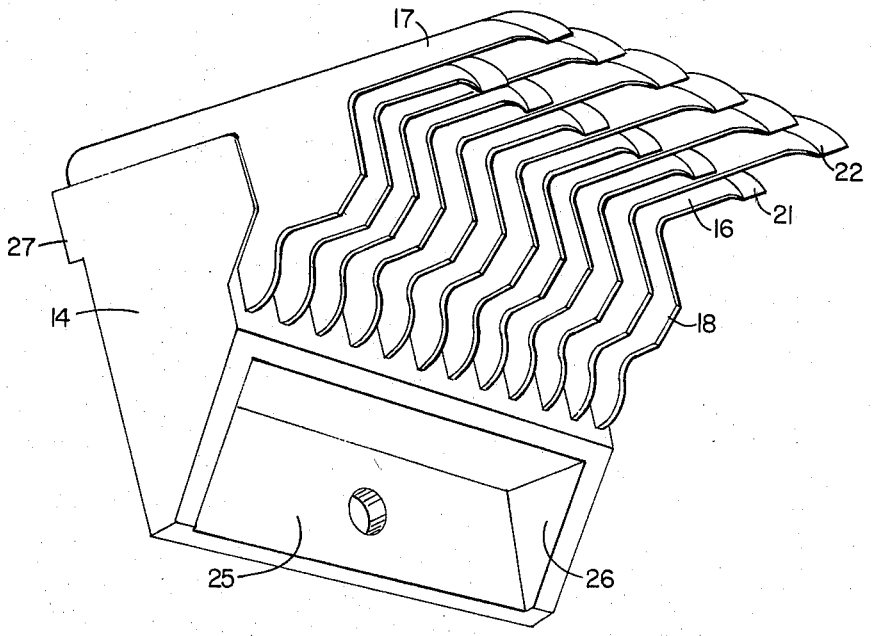
FIG. 4 is a perspective view, partly broken away, of the hook module of the invention.

Referring now to the drawings, a hook module 11 for the tuft-forming instrumentalities of a tufting machine comprises a plurality of hooks 12, 13 cast integrally with a common body part 14 to extend therefrom in spaced, side-by-side disposition.

Each hook 12, 13 includes a flat shank 15 of stepped, generally rectangular form having a blade 16, 17 respectively extending in the plane thereof to define a throat 18 extending substantially parallel to the back 19 of the hook, the back edge of the blade 16, 17, respectively, being aligned with and forming a continuation of the top 20 of the shank. At its forward end each blade 16, 17 includes a bill 21, 22 for co-operation with a tufting machine needle (not shown) and for the retention of a loop engaged by the hook. At its forward end the shank is cut away as at 23 to the stepped configuration shown, so as to provide, during use of the module, clearance for the knives engaged with respective ones of the hooks. A through hole 24 is provided in each shank 15 to receive liquid metal during the casting process, thereby to ensure positive and permanent location of the hook within the module.

Hooks 12, 13 are arranged alternately in the body part and differ only as regards the lengths of the respective blades 16, 17 thereof, the difference in length corresponding to the pitch of the staggered rows of needles provided on the needle bar.

The body part 14 is of rectangular form, and has a depending, apertured attachment flange 25 whereby the module is secured in position, with other like modules, on a looper bar, not shown, there being a triangular web 26 extending between the underside of the body part and the front of the attachment flange at each end of the said body part. A location rib 27 is provided at the rear face of the body part for location of the module on the hook bar.

As illustrated, the throats 18 and the backs 19 of all of the hooks are in alignment in the body part, as too are the backs of the cut-away shank portions 23, the latter being spaced slightly forwardly of the front face of the body part. Similarly the top edges of the shanks 15 and hence the backs 28 of the blades 16, 17, are in alignment. By virtue of the difference between the blade lengths of hooks 12, 13, one set of hooks 13 extends forwardly of the other, for co-operation with the rearmost row of needles on the needle bar.

By forming the long and short bill loopers integrally in a common cast body it is possible to produce a more stable hook bar assembly and thereby minimize deflections arising from knife loadings, and, in consequence, reduction of the incidence of unfavorable conditions in the "pick-up" area of the tuft-forming instrumentalities. Moreover, by aligning all the throats 18 of the hooks 12, 13 it is possible to regrind all the hooks as a unit when required. The grinding wheel may be placed against the throat and adjacent portion of the blade and transverse the hooks in a unit.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A hook module for a tufting machine comprising, a body member, a first and a second series of hooks each having a shank including a mounting portion, and a blade extending from said shank defining a throat therebetween and terminating at a bill, the bills of said first series of hooks being longer than those of said second series of hooks, the mounting portions of all of said hooks being fixedely cast in said body member in spaced side-by-side disposition and having all of said throats transversely aligned, the hooks of said first series being disposed intermediate the hooks of said second series, whereby the bills of said first series of hooks extend beyond the hooks of said second series of hooks, and all of said hooks may be ground as a unit.

2. A hook module as recited in claim 1 wherein said body member is formed by casting metal about said mounting portions, and each of said mounting portions includes an aperture for receiving said metal for permanently locating said hooks in said body member.

* * * * *